US005173124A

United States Patent [19]

Baxter et al.

[11] Patent Number: 5,173,124

[45] Date of Patent: Dec. 22, 1992

[54] RAPID GAS QUENCHING PROCESS

[75] Inventors: William J. Baxter, Macungie; Paul T. Kilhefner, III, Wescosville; Charles E. Baukal, Jr., Harleysville, all of Pa.

[73] Assignee: Air Products and Chemicals, Inc., Allentown, Pa.

[21] Appl. No.: 540,027

[22] Filed: Jun. 18, 1990

[51] Int. Cl.[5] ..... C21D 1/74

[52] U.S. Cl. ..... 148/633; 148/660; 148/27; 266/80; 252/372

[58] Field of Search ..... 148/16, 16.5, 20.3; 266/80

[56] References Cited

U.S. PATENT DOCUMENTS

| | | | |
|---|---|---|---|
| 4,571,273 | 2/1986 | Ebner | 148/16 |
| 4,643,401 | 2/1987 | Obman et al. | 266/80 |
| 4,867,808 | 9/1989 | Heilmann et al. | 148/16 |

FOREIGN PATENT DOCUMENTS

| | | | |
|---|---|---|---|
| 2060818 | 3/1987 | Japan | 148/16 |
| 0388038 | 10/1973 | U.S.S.R. | 148/16 |

OTHER PUBLICATIONS

P. E. Pickett, M. F. Taylor & D. M. McEligot, Heated Turbulent Flow of Helium Argon Mixtures in Tubes, pp. 705-719.

*Primary Examiner*—Upendra Roy

*Attorney, Agent, or Firm*—James C. Simmons; William F. Marsh

[57] ABSTRACT

Increased cooling rate of an article heated to an elevated temperature is achieved by flowing an inert gas mixture of helium and another inert gas over the article under conditions of turbulent flow.

10 Claims, 5 Drawing Sheets

RAPID GAS QUENCHING PROCESS

FIELD OF THE INVENTION

The present invention pertains to improving cooling rates by flowing gases over the articles to be cooled.

BACKGROUND OF THE INVENTION

In order to increase productivity in a manufacturing operation that requires heating and cooling of an article as part of the manufacturing process, accelerated heating or cooling can be effective, as long as the accelerated heating or cooling does not affect the properties of the article in its final condition.

For example, vacuum heat treating is becoming increasingly more important to the metal treater because of environmental concerns. While in the past open heating methods such as salt bath heaters have been used, environmental concerns have pushed the heat treater to heating and vacuum where the parts to be heat treated can be brought to temperature under vacuum conditions, thus preventing surface oxidation and/or surface pickup of unwanted contaminants from the atmosphere, while preventing release of unwanted components driven off in the heating process into the environment.

Conventional and state-of-the-art vacuum furnaces are available from a number of companies including Abar Ipsen Industries headquartered in Feasterville, Pennsylvania, which provide a device for the heat treater to bring parts to elevated temperature above the critical temperature at which isothermal transformation takes place. In the case of ferrous alloys, heating the metal above the transition temperature followed by rapid cooling can produce a part with extreme hardness. One method of quenching is by backfilling the vacuum furnace with an inert gas in order to cool the part back to a temperature where the surface of the part be unreactive to ambient atmosphere, once the soak temperature has been reached and the part held for sufficient time. However, in the past the only way to improve cooling rates was to make expensive modifications to the furnace in order to increase the quench pressure and blower speeds to maximize the cooling rate. Even with such modifications, the heat transfer properties of the inert quench gas remain a major limiting factor.

The U.S. Pat. No. 4,643,401 discloses a complex method using various gases cooled to cryogenic temperatues to achieve a quench after vacuum heating.

It is well known that many of the new alloys used for aerospace applications and alloys with larger cross-sections present vacuum heat treaters with problems in achieving required cooling rates utilizing furnaces of existing design. Currently two methods of increasing the cooling rate of existing equipment involve either expensive retrofits to the furnace as set forth above and/or increasing the heat transfer properties of the cooling medium. Among the many options available in retrofitting the furnace, the most popular are to increase the blower capacity of the vacuum system or to purchase an advanced plenum for more uniform and turbulent impingement of the cooling gas on the part. It is estimated that retrofit options can have a price tag in excess of $50,000 and a complete vacuum furnace replacement can cost in excess of $400,000.

Most vacuum heat treaters currently use nitrogen or argon for a quenching gas. If they required faster cooling rates, until the present invention, the only non-combustible alternative was to change to helium. While helium has the best relative cooling ability of the three gases (argon, nitrogen, helium) it has a price tag that is considerably higher than argon or nitrogen.

In the past, vacuum treaters have considered retrofitting or replacing their existing equipment, however, the cost is often prohibitive. Many titanium and high chromium alloys require very rapid cooling in order to meet material specifications. These metals require the use of argon in place of nitrogen since they are subject to nitrogen pick-up on the surface of the part during heating. The disadvantage is that argon has the poorest heat transfer characteristics. For large cross-section parts (e.g., greater than 3 inches) rapid inert cooling in vacuum furnaces has been extremely difficult. Also, current vacuum furnace technology prohibits many heat treaters from processing high speed steels in vacuum furnaces. The heat treaters are forced to put lighter loads in the furnace which significantly reduces production capabilities.

SUMMARY OF THE INVENTION

It has been discovered that when helium is blended with argon or nitrogen in specified ratios, the fastest cooling rate possible is achieved when turbulent flow conditions are maintained, as the mixture is caused to flow over or contact the article being cooled.

The process of the invention can be applied without expensive furnace modification in a vacuum furnace and is based on the relationship of convective heat transfer properties to flow characteristics in the back fill environment. Through extensive theoretical and experimental analyses, specific furnace operating characteristics which enable the vacuum furnace heat treater to achieve the same or faster cooling rates as when using 100% helium to back fill are obtained while providing a considerable cost benefit to the user.

DETAILED DESCRIPTION OF THE INVENTION

Based upon theoretical analysis it was believed that a blend of helium with another inert gas could achieve a cooling rate under conditions of turbulent flow that would be greater than helium alone.

Figure 1:
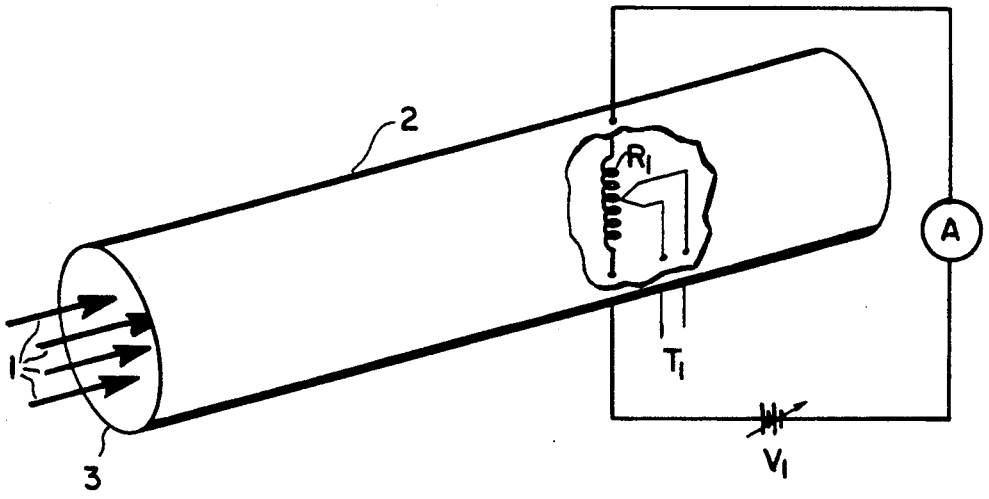
FIG. 1 is a schematic representation of an apparatus used to verify the process of the present invention.
Figure 3:
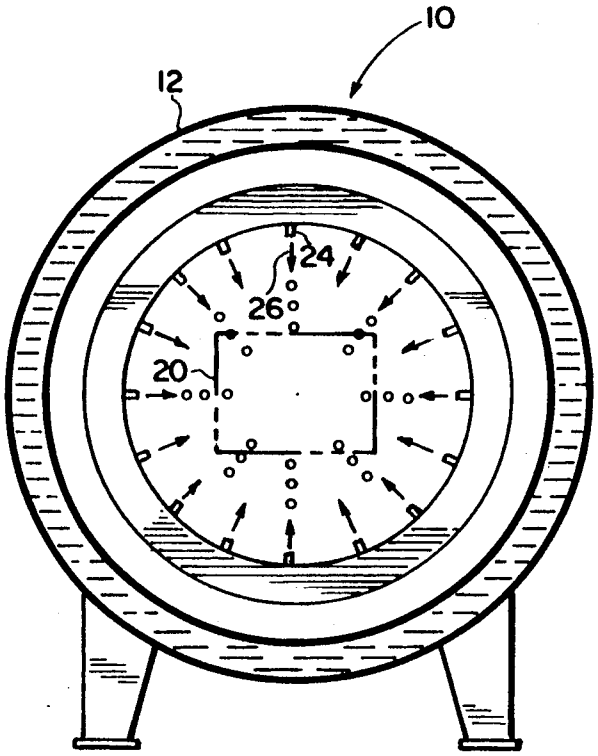
FIG. 3 is a section taken along line 3—3 of FIG. 2.

An experimental apparatus as shown schematically in FIG. 1 was constructed and tested. The apparatus shown in FIG. 1 was used to investigate the cooling effect of different gas blends. The apparatus is used to flow a gas or gas mixture shown by arrows 1 through a tube 2 two inches in diameter and three feet long. A D.C. voltage ($V_1$) is varied to maintain a resistance ($R_1$) placed approximately two feet from the entry end 3 of tube 2 at constant temperature $T_1$. The product of $V_1*i_1$ (current in circuit as measured by ammeter A), is equal to the energy extracted from $R_1$ (more specifically $[(V_1*i_1)-(V_1*i_1')]$ where prime indicates some base energy, e.g. in vacuum. A plot of $(V_1*i_1)$ versus % blend will behave the same as a plot of h (heat transfer coefficient) versus % blend and h can be derived from the data as shown in FIG. 3.

With the device of FIG. 1 it is possible to investigate effects in both laminar and turbulent flow, and in fact, monitor the transition with the apparatus. The blending of the gases took place in a specially designed panel for test programs in vacuum furnace situations. One minor change was made to the system: the resistance was recorded directly instead of calculating it with changes in current. This would reduce the possibility of calculation errors.

The experiment was conducted to measure the relative cooling ability of different helium-inert gas blends. The reasoning behind the experimental apparatus is that an inductor coil can be heated by using a voltage source, and at this elevated temperature it will have a specific resistance. When the coil is cooled the resistance will decrease. Thus, different gas blends being introduced at turbulent flow conditions (Reynolds number > 1800 for this experiment), will cool the part differently and will therefore alter the resistance of the coil. This resistance is then measured and recorded.

For the experiment a 50 Volt supply ($V_1$) was used to heat the copper inductor coil ($R_1$). For each blend, in 10% increments from 100% argon to 100% helium, the voltage was checked and altered to ensure a continuous 50 volts. The resistance was then measured, using an electrical ammeter, across the inductor coil down to the nearest thousandth of an amp. This procedure was then duplicated to ensure accurate results. As can be seen in the plot of the experimental results in FIG. 4, there was a significant change in the resistance when the blend of the cooling gas was altered.

Figure 4:
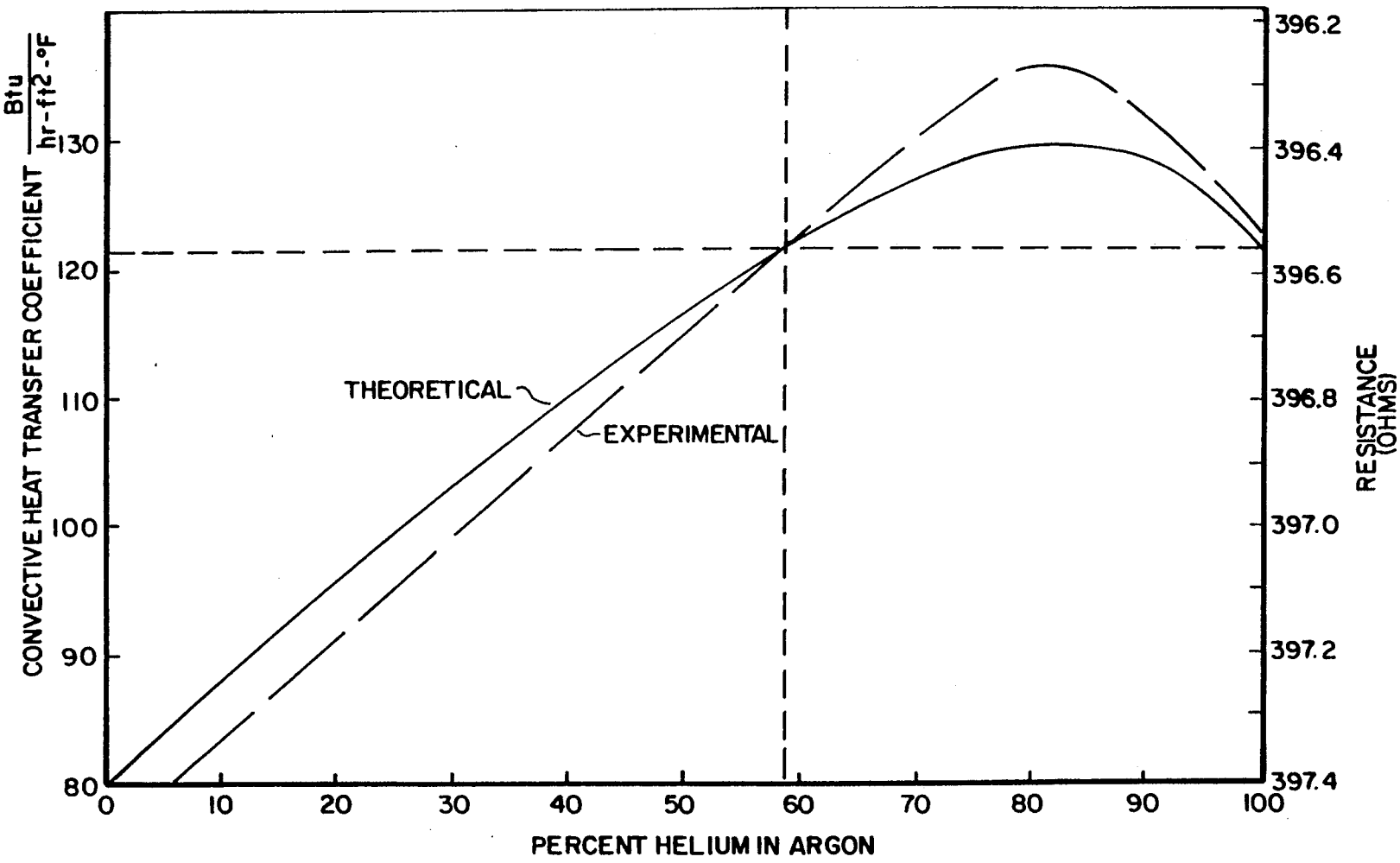
FIG. 4 is a plot of percent Helium in Argon versus convective heat transfer coefficient and resistance as measured in the apparatus of FIG. 1.

The plot of the resistance change was then superimposed on a convective heat transfer coefficient plot as shown in FIG. 4. The data was plotted to demonstrate the effect of a blend having the best cooling ability. The resistance plot was shown to have an inverse relationship with the heat transfer coefficient and the same trends. In other words, the best theoretical blend was also the best experimental blend.

Understanding the problem facing the heat treat industry and the desire of the industry to increase heat transfer while maintaining the option of not having to accomplish expensive furnace retrofits or increase operating costs for more expensive helium gas, the starting point for developing the present invention was a theoretical analysis which compared the relative cooling ability to several inert quench gases used in vacuum furnace systems. It was shown that argon gas could cool a part at 79° F. per minute under the same operating conditions that helium would cool the same part at a rate of 135° F. per minute. Thus, a 68% increase in the cooling rate could be achieved with helium. However, as pointed out above, helium is considerably more expensive than argon.

It is also understood that the cooling ability of the quench gas is directly related to the convective heat transfer coefficient of the gas. In view of the fact that the heat transfer coefficient of the gas is highly dependent on the type of flow, different types of flow schemes were analyzed. In the case of vacuum furnaces, the gas is flowed at very high velocities with new designs having gas recycle flow rates of up to 15,000 cubic feet per minute (cfm). The higher flow rate contributes to the larger turbulent flow regions in the furnace and to very rapid cooling rate as compared to lower flow rates.

For turbulent flow conditions, the convective heat transfer coefficient is a function of both the Reynolds number and the Prandtl number. Both of these are highly dependent on the properties of the quench gas. The Reynolds number is a function of the density and viscosity of the gas and the Prandtl number is a function of the viscosity, the heat capacity, and the thermal conductivity. Thus, according to the formulas below representing turbulent flow in a tube the properties will vary with different gas blends.

$$h = \frac{0.256\,k}{D}\,Re^{0.8}Pr^{0.4}$$

$$Re = \frac{D\,Vmax\,\rho}{\mu}$$

$$Pr = \frac{Cp\,\mu}{k}$$

Where:
$h$ = convective heat transfer coefficient
$Re$ = Reynolds number
$D$ = Diameter of cylinder
$Pr$ = Prandtl number
$Cp$ = heat capacity at constant pressure
$Vmax$ = maximum velocity
$\rho$ = density
$k$ = thermal conductivity
$\mu$ = viscosity The variation of properties results in a non-linear relationship between the convective heat transfer coefficient and the gas blend. Using the foregoing formulas it can be shown that the Reynolds number is relatively linear with respect to gas composition because the density is linear and the velocity has only slight variation from linearity. The Prandtl number, however, contains the heat capacity and the thermal conductivity, two non-linear terms. This would result in the Prandtl number showing an almost parabolic relationship for blends of gas where there is a significant difference in the densities. This relationship is disclosed in the article "Heated Turbulent Flow of Helium-Argon Mixtures in Tubes" by P. E. Pickett, M. F. Taylor and D. M. McEligot appearing in Vol. 22 of the International Journal of Heat and Mass Transfer (1979). Since the Reynolds and Prandtl numbers are both raised to powers that are less than one and the Prandtl number is less than 1, mathematical relations creates peaks in the convective heat transfer coefficient. This preliminary analysis led to the conclusion that it may be possible to have a blend of gas that had a better cooling capability than a single gas provided certain conditions were met.

Figure 2:
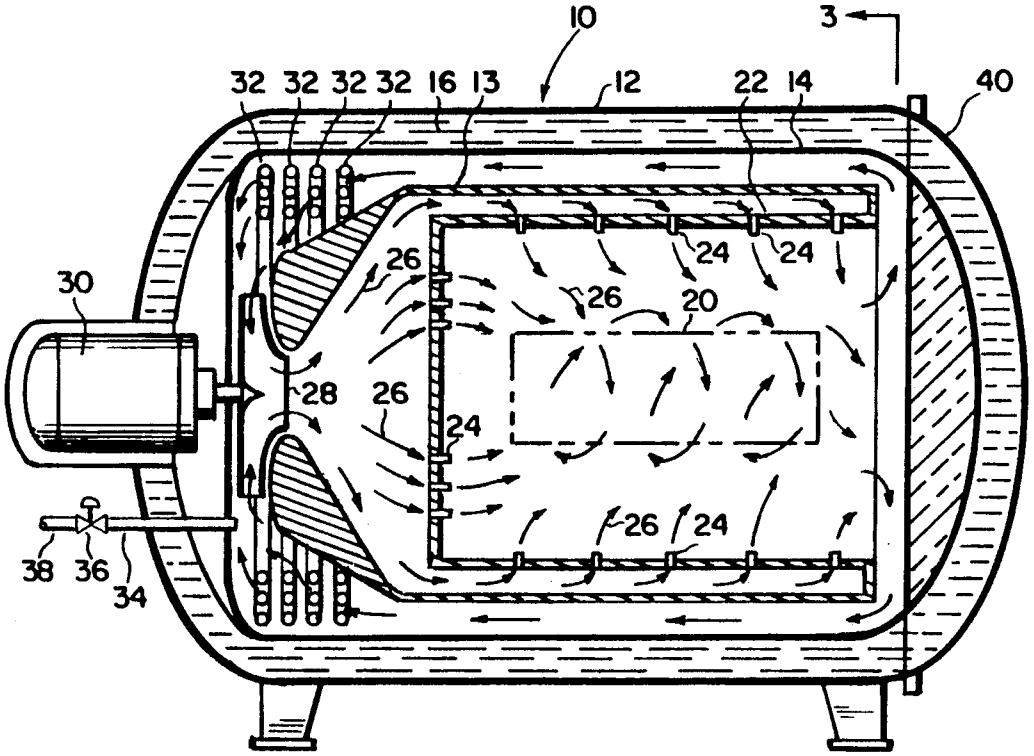
FIG. 2 is a longitudinal section through a state-of-the-art vacuum furnace modified in accordance with the present invention.

Referring to FIG. 2, 10 shows generally a vacuum heat treating furnace sold by Abar Ipsen Industries under the Turbo Treater trademark. The furnace 10 includes an outer shell 12 and an inner shell 14 the space between defining a fluid cooling (e.g., water) jacket 16. Disposed within the inner shell is a hearth 18 which can be heated to elevated temperature in order to raise the parts to be treated held in a fixture 20 to the proper temperature. Disposed within the hearth 18 is a internal gas distribution system 22 having a series of inlet ports 24 which permit recirculation of a gas as shown by the arrows 26 inside of the gas distribution device 22 by means of a turbine blade 28 which is driven by a motor 30. The gas driven by turbine 28 is forced through the distributor 22, nozzles 24 over the particles and is then caused to pass over a series of cooling coils 32 through which water is circulated to cool the gas before it is reintroduced into the hot zone of the furnace.

Furnace 10 also includes an inlet conduit 34 having a control valve 36 which in turn is connected by a conduit 38 to a source of cooling gas (not shown). The source for cooling gas can be individual cylinder high pressure tube trailers or liquid storage tanks with suitable vaporizers. The delivery system can include a conventional blend panel (not shown) to provide blends according to the present invention.

In order to complete a heat treating process, the user would open the end of the furnace 10 via the door 40 which is sealably removable from the end of the furnace shelf 12 to gain access to the interior of the furnace so that the parts can be loaded in the part fixture 20. The door 40 is then closed sealing the furnace. The interior of the furnace is evacuated and the parts brought to temperature. After the parts have reached temperature and have been uniformally heated to temperature, the heating elements are turned off and gas is admitted to the interior of the furnace through a conduit 32 and caused to circulate inside the furnace by means of the turbine 28. As soon as the parts have reached the lower critical temperature or room temperature (depending on the composition of the parts) the door 40 can be opened and the parts removed to ambient temperature for cool to ambient.

According to the present invention, it was discovered and is shown in FIG. 4 through both theoretical and experimental results, that when argon is blended with helium and the helium is present in an amount equal to at least 59% by volume of the mixture, theoretical calculations show that there would be an increase in the convective heat transfer coefficient. What is more surprising, the curve labeled experimental shows that experimental results obtained by actually processing parts according to the present invention show that the actual effect was greater than would be expected from the theoretical calculation.

Furthermore, experiments were run.

A series of tests were run in an Abar Ipsen production furnace to verify the fact that rapid gas quench (RGQ) gas blends can achieve faster cooling rates than that which is found using helium alone.

The tests were run in order to compare cooling rates obtained using a 60% helium, 40% argon blend and 80% helium, 20% argon blend in order to evaluate the fastest, slowest and average cooling rates recorded in the test load using ten different thermocouples located throughout the load. The tests were run in a 5-bar Abar Ipsen turbo treater furnace at 4.75 bar using a 10,000 cubic feet per minute blower speed, with a furnace hot zone 48 inches diameter by 60 inches deep. Nitrogen and Argon were supplied from an existing in-house line at the furnace site and helium and argon mixtures were supplied utilizing a high pressure on-site tube trailer. All gases were preblended prior to being introduced into the high pressure tube trailer.

For each test the load weighed 1,844 pounds and was made up of 1 inch diameter by 4 inch long steel cylinders located in three baskets. Ten thermocouples were placed in various locations in the load and the load was heated to 2,200° F. and quenched.

Figure 5:
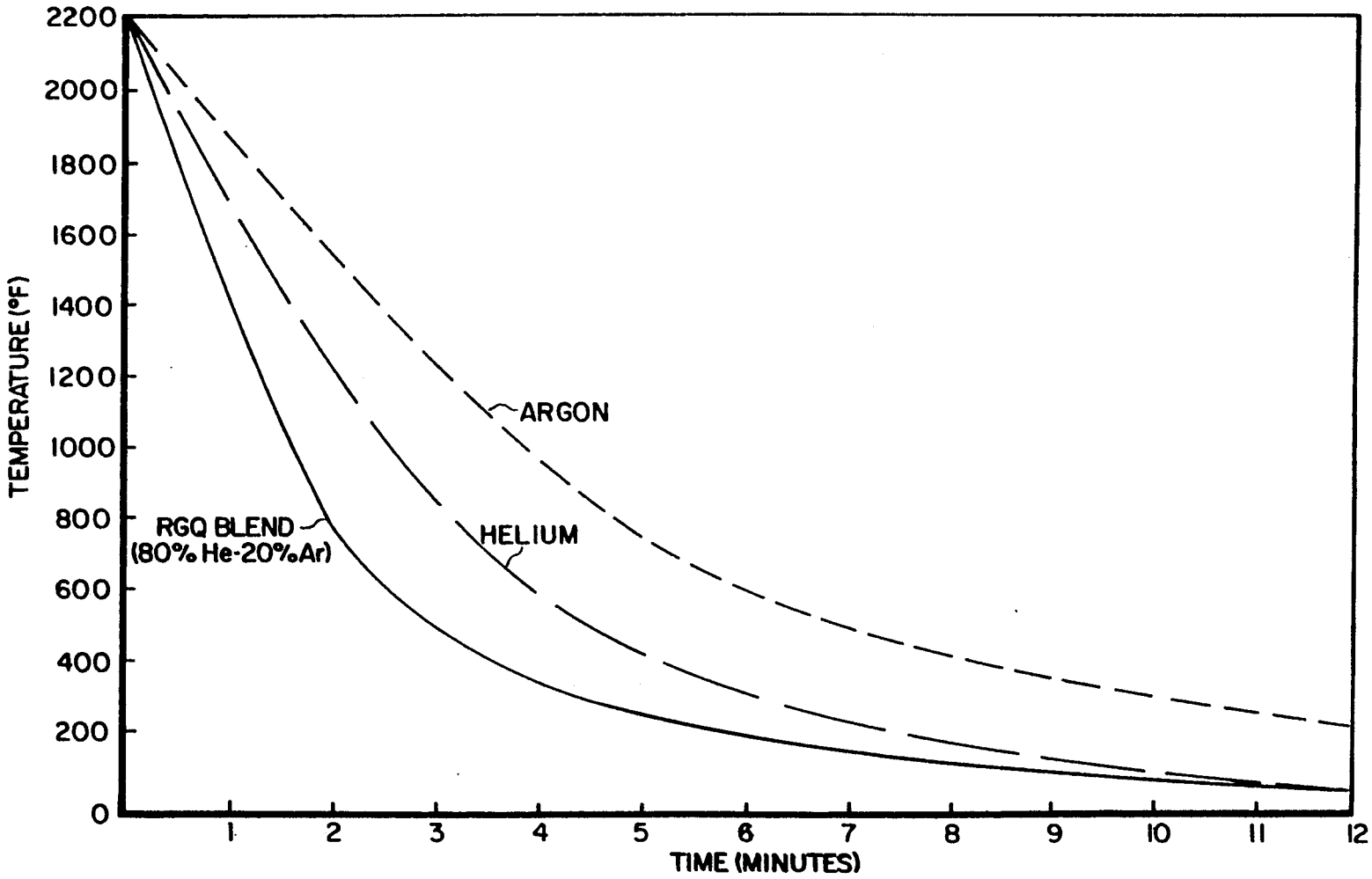
FIG. 5 is a plot of time versus temperature showing the test results gathered in the field for Argon and Helium and a blend according to the present invention.

FIG. 5 is a plot of time versus temperature for the test set out above wherein the RGQ blend curve is for a 80% helium, 20% argon mixture. A mixture of 60% helium, 40% argon approximates but would be slightly to the left of the curve for helium mixture and represent the thermocouples showing the fastest cooling rate in the load. The thermocouple showing the average temperature of the load would have a curve below that of helium for the 80-20 blend and one that is closer but below the helium curve for the 60-40 blend. Thus from FIG. 4 it is apparent that an 80% helium, 20% argon mixture provides the fastest cooling rate.

Figure 6:
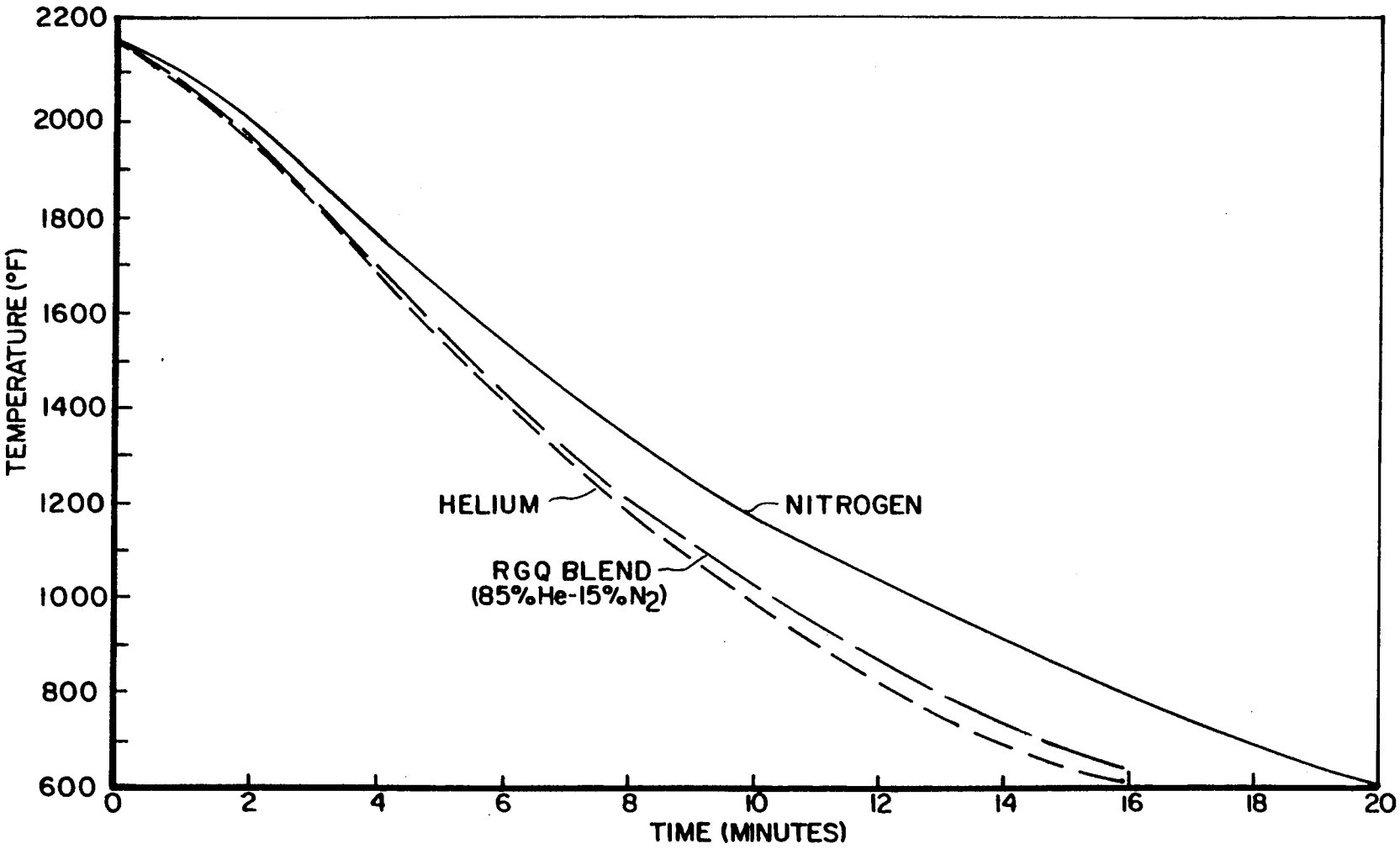
FIG. 6 is a plot of time versus temperature showing cooling rates for Nitrogen and Helium and blends according to the present invention.

FIG. 6 is a plot of a series of tests where the RGQ blend was 15% percent nitrogen in helium mixtures by volume under conditions approaching turbulent flow. As shown in FIG. 6, the use of a nitrogen-helium blend while at the onset of cooling closely approximates that of helium, it is not quite as effective as helium. However, for those applications where a slightly lower cooling rate is viable toward the end of the cooling cycle, the helium and nitrogen blends can effect significant savings for the heat treater.

From the foregoing it is apparent that according to the present invention, vacuum heat treaters will achieve the benefits of, increased production, reduced operating cost, improved metallurgical properties and increased furnace flexibility to handle other materials, the ability to handle larger loads or different cross-sections of parts because they now have a process that can increase the cooling rate in the vacuum furnace.

The process of the present invention utilizing a gas blend and turbulent flow provides effective cooling at lower cost.

Having thus described our invention what is desired to be secured by Letters Patent of the United States is set forth in the appended claims.

We claim:

1. A method of increasing the cooling rate of an article heated to an elevated temperature comprising the steps of:

preparing a gaseous mixture of helium gas and a second inert gas wherein there is at least 50% of the second inert gas in the mixture; and injecting said gaseous mixture into said furnace under conditions of turbulent flow.

2. A method according to claim 1 wherein said second inert gas is selected from the group consisting of nitrogen and argon.

3. A method according to claim 1 wherein the Reynolds number of the blend exceeds that which represents turbulent flow.

4. A method according to claim 2 wherein the second gas is argon present in an amount to a maximum of 41% by volume.

5. A method according to claim 2 wherein the second gas is argon and the mixture is 20% argon by volume, balance helium.

6. A method of increasing the cooling rate in a vacuum furnace backfilled with a gaseous heat transfer medium comprising the steps of:

preparing a gaseous mixture of helium gas and a second inert gas wherein there is at least 50% of the second inert gas in the mixture; and injecting said gaseous mixture into said furnace under condition of turbulent flow.

7. A method according to claim 6 wherein said second inert gas is selected from the group consisting of nitrogen and argon.

8. A method according to claim 6 wherein the Reynolds number of the blend exceeds that which represents turbulent flow.

9. A method according to claim 7 wherein the second gas is argon present in an amount to a maximum of 41% by volume.

10. A method according to claim 7 wherein the second gas is argon and the mixture is 20% argon by volume, balance helium.

* * * * *

UNITED STATES PATENT AND TRADEMARK OFFICE

CERTIFICATE OF CORRECTION

PATENT NO. : 5,173,124

DATED : December 22, 1992

INVENTOR(S) : WILLIAM J. BAXTER , ET AL

It is certified that error appears in the above-identified patent and that said Letters Patent is hereby corrected as shown below:

Column 6, lines 45-46 delete "50% of the second insert gas" and substitute therefor --59% helium--.

Column 6, lines 65-66 delete "50% of the second inert gas" and substitute therefor --59% --.

Signed and Sealed this

Sixteenth Day of November, 1993

*Attest:*

Bruce Lehman

BRUCE LEHMAN

*Attesting Officer*

*Commissioner of Patents and Trademarks*